United States Patent [19]

Ring

[11] Patent Number: 4,917,174

[45] Date of Patent: Apr. 17, 1990

[54] SUPPLY AIRFLOW CONTROL FOR DUAL-DUCT SYSTEM

[75] Inventor: Harry K. Ring, Houston, Minn.

[73] Assignee: American Standard Inc., New York, N.Y.

[21] Appl. No.: 223,584

[22] Filed: Jul. 25, 1988

[51] Int. Cl.[4] ..... F25B 29/00; F24F 3/052

[52] U.S. Cl. ..... 165/26; 165/27; 165/22; 165/16; 236/49.3; 236/13

[58] Field of Search ..... 236/13, 49 D; 165/22, 165/26, 27, 16

[56] References Cited

U.S. PATENT DOCUMENTS

| | | | |
|---|---|---|---|
| 2,970,768 | 2/1961 | Curran | 236/13 |
| 3,568,760 | 3/1971 | Hogel | 165/22 |
| 3,934,795 | 1/1976 | Ginn et al. | 236/13 |
| 4,136,732 | 1/1979 | Demaray et al. | 165/16 |
| 4,182,484 | 1/1980 | Stanke et al. | 236/1 |
| 4,244,517 | 1/1981 | Stanke et al. | 236/49 |
| 4,422,571 | 12/1983 | Bowman | 236/49.3 |
| 4,495,986 | 1/1985 | Clark et al. | 165/2 |
| 4,534,406 | 8/1985 | Newell, III et al. | 165/26 |

*Primary Examiner*—John Ford

*Attorney, Agent, or Firm*—William J. Beres; William O'Driscoll; Robert J. Harter

[57] ABSTRACT

Two variable position supply air valves, one for modulating warm airflow to a comfort zone and the other for modulating cool airflow, each have a constant intermediate open position to provide at least a desired minimum airflow, and both can be controlled so that only one valve is open at any one time to minimize any mixing of the airstreams. Potentiometers are used to adjust the intermediate open position of each valve and to adjust at least one valve's relationship of valve opening to zone temperature.

24 Claims, 3 Drawing Sheets

FIG. 1
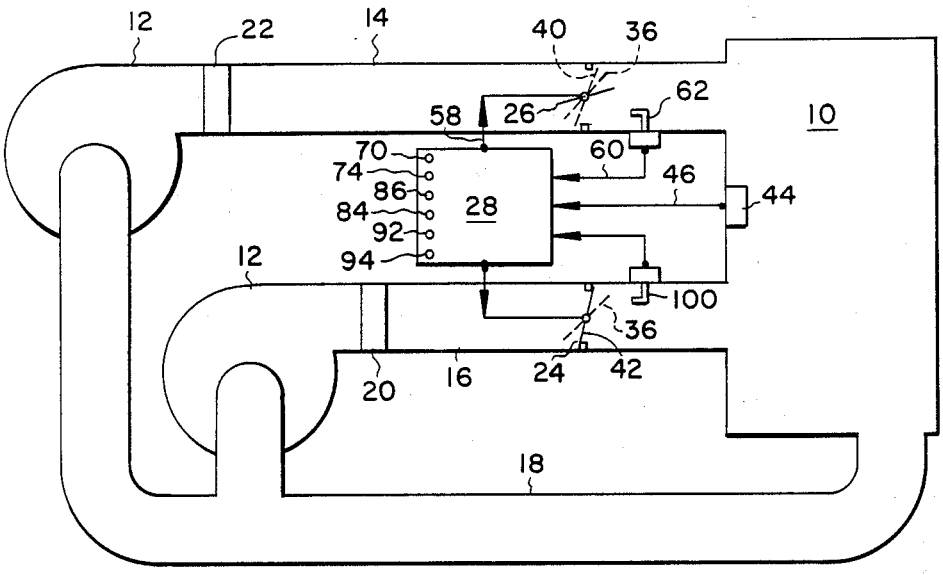
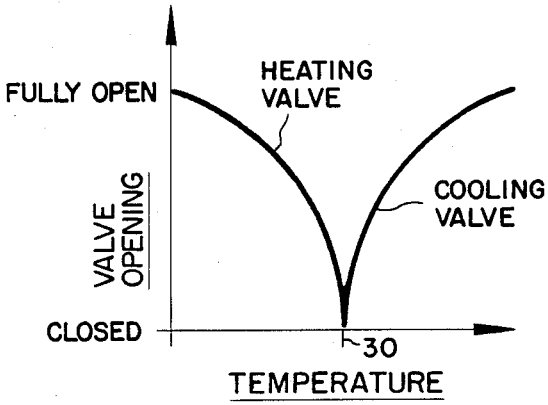
FIG. 2
(PRIOR ART)
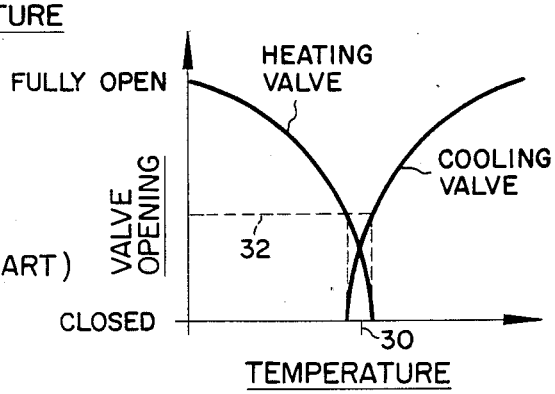
FIG. 3
(PRIOR ART)

SUPPLY AIRFLOW CONTROL FOR DUAL-DUCT SYSTEM

TECHNICAL FIELD

This invention generally pertains to HVAC (heating, ventilating, and air conditioning) equipment and more specifically to the control of a VAV (variable air volume) heating valve and a VAV cooling valve to provide at least a minimum supply airflow rate while minimizing the mixing of warm and cool supply air.

BACKGROUND OF THE INVENTION

The temperature of a comfort zone within a building can be controlled by modulating the airflow rate of warm or cool air supplied to the zone. This is typically accomplished with the use of at least two VAV valves, one for a warm air supply duct and another for a cool air supply duct. Both supply air ducts serve the same zone and may share a common blower. Downstream of the blower(s), however, the ducts convey separate airflows corresponding to separate heat exchangers, one for heating and the other for cooling.

The rate of airflow through each valve is modulated to meet the comfort zone's temperature conditioning demand as determined by a thermostate. At low demand, both valves may be substantially closed, and the speed of the supply air blowers may be reduced to save energy. However, it is usually desirable to maintain at least a minimum airflow rate for ventilation purposes, even though the temperature conditioning demand has been satisfied. When the temperature of the zone has reached its set point, many controls provide minimum airflow by slightly opening both the heating and the cooling valves an equal amount. When a demand for heat or cooling arises, the valves begin to open further or close accordingly. As the demand further increases, the valves continue to move, and eventually one fully closes and only the other is controlled to meet the demand.

Accurate modulation of airflow can be difficult when operating in a relatively narrow minimum airflow region, where both valves are only partially open a slight amount around the set point temperature. This is because accurate measurement of low airflow rates requires a relatively sensitive flow sensor. In addition, a slight change in valve position can cause a dramatic change in airflow at low airflow rates. A further complication arises when the heated air supplies more heat than an equal amount of cooled air can remove, or vice versa. This imbalance should be compensated to avoid a net heating or cooling effect when the temperature conditioning demand has been satisfied, i.e., the zone temperature equals its set point. In addition, the mixing of heated and cooled air should be avoided whenever possible to minimize energy consumption.

SUMMARY OF THE INVENTION

An object of the invention is to minimize the mixing of warm and cool supply air whose flow rate is modulated by two VAV valves for satisfying the temperature conditioning demand of a comfort zone.

Another object is to maintain a constant minimum airflow to a comfort zone when its temperature conditioning demand is substantially satisfied.

Another object is to provide means for adjusting the minimum airflow setting of each VAV valve.

Yet another object of the invention is to provide means for adjusting the width of a dead band where either one of the two valves is at a relatively constant intermediate open position.

A feature of the invention is a relatively narrow region of hysteresis within the dead band to minimize alternate valve cycling near the comfort zone's set point temperature.

These and other objects and features of the invention are provided by a novel HVAC apparatus for conditioning the temperature of a comfort zone. The HVAC apparatus includes two VAV valves, one for modulating warm airflow to a comfort zone and the other for modulating cool airflow. The opening of the valves are controlled such that only one valve is open at a time to minimize any mixing of warm and cool supply air. In addition, each valve has a intermediate open position for providing at least a predetermined minimum airflow when the zone temperature is near its set point.

BRIEF DESCRIPTION OF THE DRAWINGS

FIG. 1 shows an HVAC system incorporating the invention.

FIG. 2 shows the relationship of valve position to comfort zone temperature for a hypothetical HVAC system not having any minimum airflow requirements.

FIGS. 3 and 4 show the relationship of valve position to comfort zone temperature for two other hypothetical HVAC systems having a minimum ventilation requirement.

DESCRIPTION OF THE PREFERRED EMBODIMENT

Figure 4:
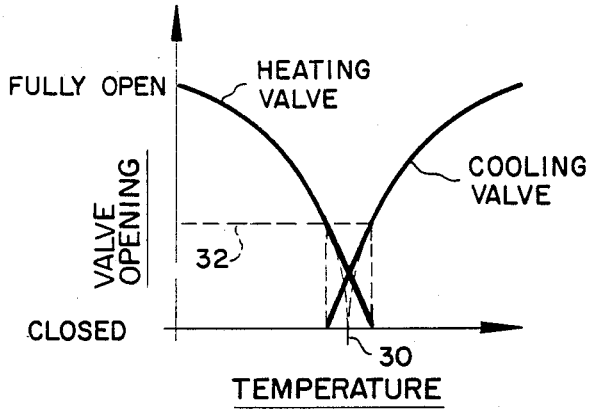
FIG. 4 PRIOR ART

A dual-duct VAV system, shown in FIG. 1, is connected to condition the temperature of a comfort zone 10, such as a room within a building. Two blowers 12 circulate temperature conditioned air through zone 10 by way of two separate supply air ducts 14 and 16 and return air duct 18. Supply air in duct 16 is heated by a heater 20 before it is delivered to zone 10. Heater 20 represents any device for heating air such as an electrical resistance heating element, a combustion gas heat exchanger, a steam coil, or a refrigeration condenser. Likewise, the supply air in duct 14 is cooled by heat exchanger 22 before being supplied to zone 10. Heat exchanger 22 represents any device for cooling air such as a water coil or a refrigeration evaporator. After passing through zone 10, the air returns to the suction side of blowers 12 by way of return air duct 18. A heating valve 24 and a cooling valve 26 are VAV valves that modulate the airflow through duct 16 and 14 respectively. Exemplary VAV valves are disclosed in U.S. Pat. Nos. 4,749,000 and 4,749,001, specifically incorporated by reference herein. The degree of opening of valves 24 and 26 is controlled by a controller 28.

The actual control scheme of controller 28 will be best understood by first referring to the hypothetical control schemes shown in FIGS. 2 through 4. If no minimum airflow was ever required, a desirable valve opening to zone temperature relationship may look as shown in FIG. 2. Both the heating and cooling valves would be closed when the zone temperature is at its set point 30. As the zone temperature deviates from set point 30, the appropriate heating or cooling valve would open to meet the demand.

If a minimum airflow was desired for ventilation purposes, the curves of FIG. 2 can be shifted to cross at set point 30, as shown in FIG. 3. Dashed line 32 represents the valve opening that provides the desired minimum airflow when one of the two valves is completely closed. Coordinating the proper actuation of both valves requires close tolerance flow sensors when operating below line 32, because the slope of the curves are relatively steep. Moreover, due to the non-linearity of the curves, the amount of ventilating airflow at set point 30 is greater than the desired minimum at line 32. To compensate for these problems, the relationship between valve opening and temperature can be modified to provide a linear relationship in the control region below dashed line 32, as shown in FIG. 4. Unfortunately, providing such a control scheme is not only relatively complicated but also results in excessive mixing of both warm and cool supply air near the set point.

Figure 5:
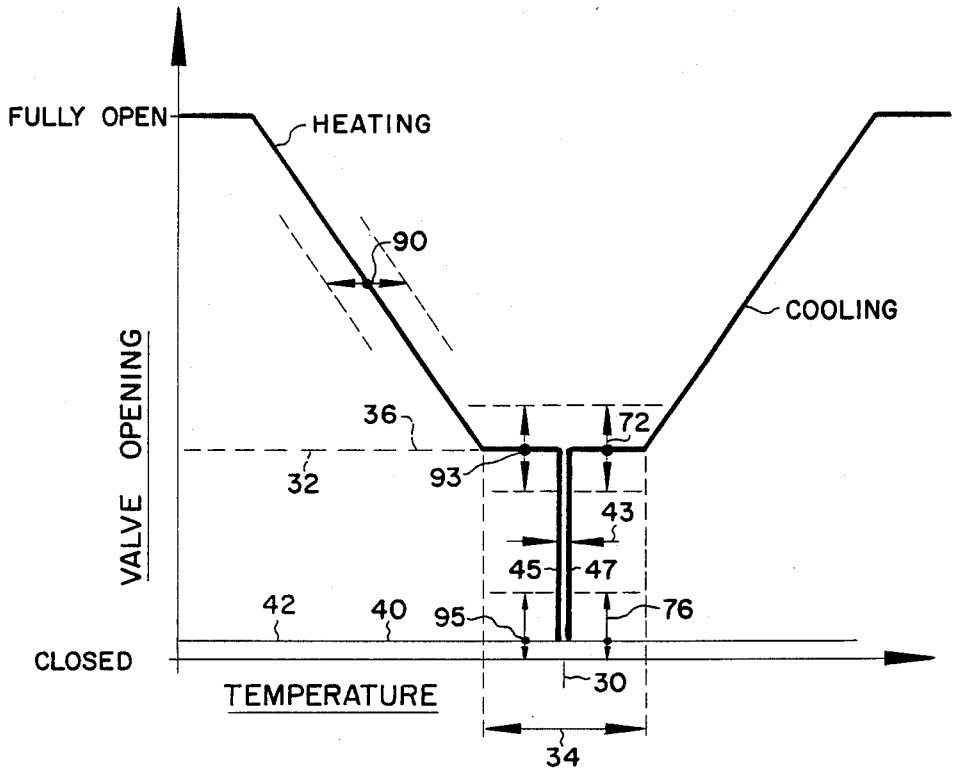
FIG. 5 shows the relationship of valve position to comfort zone temperature for the subject invention.

Control 28 avoids the problems of the hypothetical controls by providing a relationship of valve opening to temperature as shown in FIG. 5. Control 28 includes a dead band region 34, i.e., the temperature range over which the position of the furthest open valve (valve 24 or 26) does not vary as a function of temperature. However, the dead band region does not include the temperature range over which either valve, 24 or 26, is fully open. Within dead band region 34, one of the two valves is at a a predetermined minimum position 40 or 42 (FIG. 1) while the other is held at a generally constant intermediate open position 36 to provide the minimum desired airflow rate for adequate ventilation. The term, "minimum position" is any position less than fully open, and the term, "intermediate open position" is any position between fully open and the minimum position. In one embodiment of the invention, the minimum position is substantially closed. When the zone temperature is below set point 30 but within dead band 34, heating valve 24 is at its generally constant intermediate open position 36 while cooling valve 26 is at its minimum position 40, e.g., nearly closed. When the zone temperature is above set point 30 but within dead band 34, cooling valve 26 is at its intermediate open position 36 whle heating valve 24 is at its minimum position 42, e.g., fully closed.

In one embodiment of the invention, set point 30 is at an unstable point of transition where one valve opens while the other closes. The valves may be actuated sequentially or simultaneously, depending on the specific control details. Regardless of the actuation sequence, set point 30 does not represent a stable condition where both valves are maintained in a partially open position according to one embodiment of the invention.

A narrow range of hysteresis may be present at set point 30 to minimize alternate cycling of the valves. In other words, once the valves have switched, the zone temperature must deviate a predetermined amount from the point of switching before the valves can switch back. Although a certain degree of hysteresis is desirable, it is not a requirement of the invention.

Although FIG. 5 shows a slight separation 43 at set point 30, between lines 45 and 47, the separation is shown only to illustrate the distinction between the heating and cooling curves. In actuality, the two lines may completely overlap, cross, or the location of the two lines may be interchanged due to the hysteresis just mentioned.

Beyond dead band 34, control 28 operates in a somewhat similar fashion as the controls represented by FIGS. 2 through 4. However, the non-linear relationship between valve position and temperature has been modified using straight line approximation for simplication.

The straight line approximation can be avoided by employing an airflow sensors 62 and 100 for sensing the actual airflow rate through valves 24 and 26. Although control 28 can vary valve position as a function of temperature without the use of flow sensor 62 as described above, using sensor 62 can provide a greater degree of control. When an airflow sensor is used, the term "minimum position" used herein represents any airflow rate that is less than that provided by the fully open position, and the term "intermediate open position" used herein represents any airflow rate that is between that which is provided by the fully open and minimum position.

Figure 6:
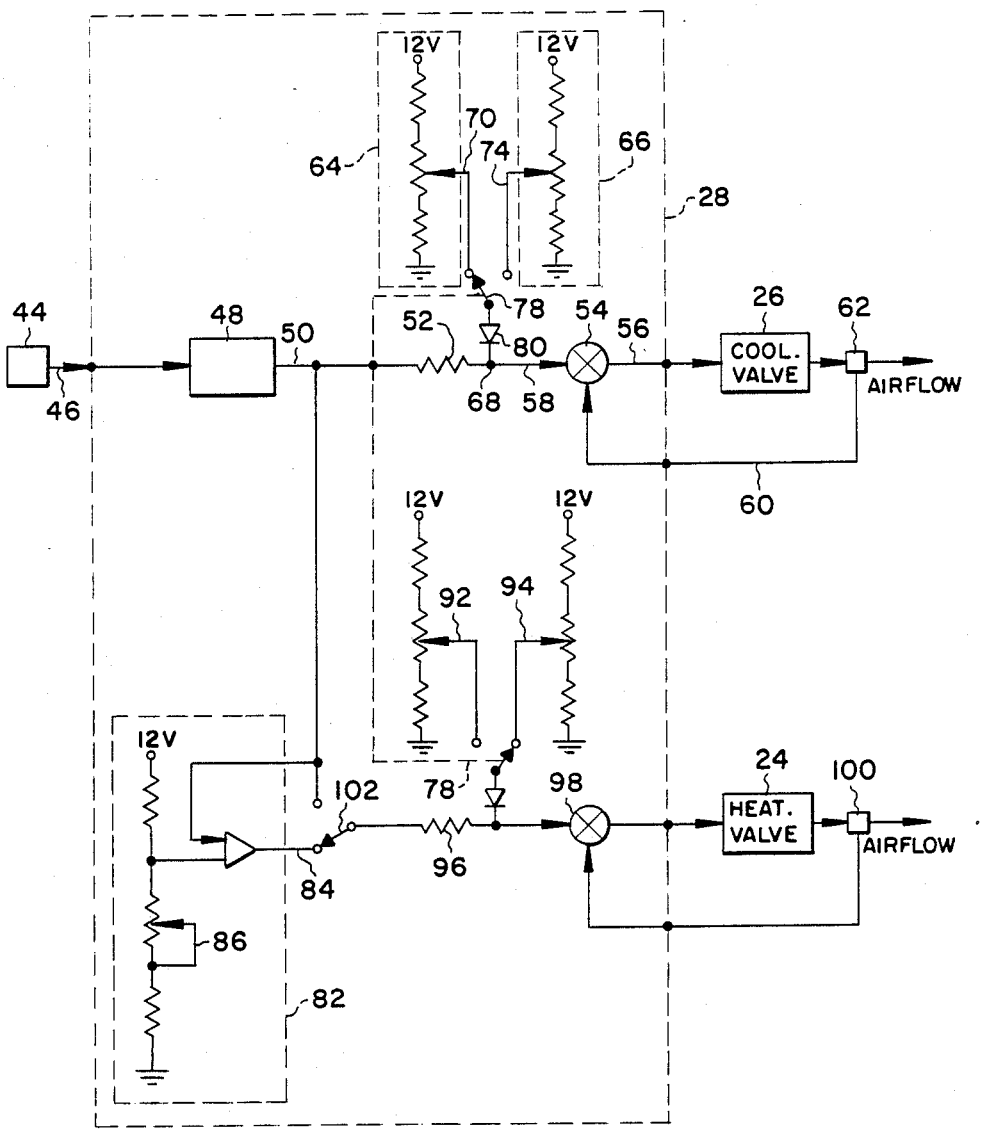
FIG. 6 is a schematic diagram of the control shown in FIG. 1.

Further details of control 28 are shown in FIG. 6. A thermostat 44 provides a signal 46 representing the temperature difference between an actual temperature associated with zone 10 and its set point 30. A signal conditioner 48 provides a transfer function that transfers the incoming signal 46 to an output signal 50 that is adapted to control valves 24 and 26. Signal conditioner 48 can provide any one of a variety of commonly used transfer functions such as proportional, integral, or proportional plus integral control. Signal 50 is conveyed to cooling valve 26 by way of a resistor 52 and a summing junction 54. Summing junction 54 delivers a control signal 56 to valve 26 upon comparing signal 58 to an airflow feedback signal 60 generated by an airflow sensor 62. Resistor 52 is of sufficient ohmic resistance to enable potentiometer circuit 64 and 66 to impose predetermined minimum voltage levels at node 68.

Potentiometer 70 adjusts the intermediate open position 36 of cooling valve 26 is indicated by numeral 72 of FIG. 5. And potentiometer 74 determines the cooling valve's minimum position 40 as indicated by numeral 76 of FIG. 5. In response to the level of output signal 50, a switching circuit 78 automatically determines which predetermined minimum voltage should be imposed on node 68. As indicated by FIG. 5, switching occurs at approximately set point 30. Diode 80 allows the voltage at node 68 to exceed either of the two predetermined minimal voltage levels for controlling the valves in the region above line 32 of FIG. 5.

Referring back to FIG. 6, a second signal conditioning circuit 82 provides a heating valve control signal 84 in response to signal 50. Circuit 82 includes a potentiometer 86 that varies the relationship of temperature to heating valve position as indicated by numeral 90 of FIG. 5. It should be clear that varying the relationship as indicated by numeral 90 also varies the width of dead band 34. Similar to the cooling valve coontrol, a potentiometer 92 determines the heating valve's intermediate open position 36, as indicated by numeral 93 of FIG. 5. And a potentiometer 94 determines the valve's minimum position 42, as indicated by numeral 95 of FIG. 5. Resistor 96, summing junction 98, and airflow sensor 100 are the heating valve's counterpart to the cooling valves's resistor 52, summing junction 54, and airflow sensor 62 respectively. Switch 102 provides a means of bypassing circuit 82, whereby valves 24 and 26 can be operated in a second mode where both valves move in unison rather than in opposition. This feature is useful in some systems where it is desirable to operate in the second mode where both ducts provide heating, or both supply cooling, or to simply convey unconditioned air through both valves simultaneously. FIG. 5 represents the first mode of operation.

It should be noted that potentiometers 70, 74, 86, 92, and 94 represent any means (e.g., EEPROM) for adjusting the response of control 28 to provide the response described above.

Although the invention is described with respect to a preferred embodiment, modifications thereto will be apparent to those skilled in the art. Therefore, the scope of the invention is to be determined by reference to the claims which follow.

I claim:

1. An HVAC apparatus for conditioning the temperature of a comfort zone comprising:

a temperature sensor for sensing an actual temperature associated with said zone;

a heating valve operative in a first mode for modulating the flow rate of heated air conveyed to said zone, except for possibly hysteresis range around a set point temperature, when said actual temperature is immediately below said set point temperature and said hysteresis range if present said heating valve is maintained at a first substantially constant intermediate open position within a dead band region and provides a variable degree of opening that varies as a function of said actual temperature beyond said dead band region, said heating valve being maintained at a first substantially constant predetermined minimum position that is less than said first intermediate open position when said actual temperature is immediately above said set point temperature and said hysteresis range if present; and a cooling valve operative in a first mode for modulating the flow rate of cooled air conveyed to said zone, except for possibly some hysteresis range around said set point temperature, when said actual temperature is immediately above said set point temperature and said hysteresis range if present, said cooling valve is maintained at a second substantially constant intermediate open position within said dead band region and provides a variable degree of opening that varies as a function if said actual temperature beyond said dead band region, said cooling valve being maintained at a second substantially constant predetermined minimum position that is less than said second intermediate open position when said actual temperature is immediately below said set point temperature and said hysteresis range if present, whereby said heating and cooling valves assure a predetermined minimum airflow rate around said set point temperature.

2. The HVAC apparatus as recited in claim 1, further comprising a heater disposed upstream of said heating valve and a cooling heat exchanger disposed upstream of said cooling valve, said valves being disposed in separate supply air ducts.

3. The HVAC apparatus as recited in claim 1, wherein said valves are selectively operative in said first and a second mode, with said valves moving in unison during said second mode.

4. The HVAC apparatus as recited in claim 1, further comprising at least a first potentiometer for adjusting said first and second substantially constant intermediate open positions of said heating valve and said cooling valve so that said intermediate open positions are not necessarily equal.

5. The HVAC apparatus as recited in claim 1, further comprising a second potentiometer for adjusting said dead band region.

6. The HVAC apparatus as recited in claim 1, further comprising at least a third potentiometer for adjusting said first and second predetermined minimum positions of said heating valve and said cooling valve.

7. The HVAC apparatus as recited in claim 1, wherein said valves are substantially closed when at their said minimum position to minimize any mixing of said heated air and said cooled air.

8. The HVAC apparatus as recited in claim 1, further comprising a control for simultaneously switching said valves between said intermediate open position and said minimum position when said actual temperature reaches said set point temperature.

9. The HVAC apparatus as recited in claim 1, further comprising a control for sequentially switching said valves between said intermediate open position and said minimum position when said actual temperature reaches said set point temperature.

10. An HVAC apparatus for conditioning the temperature of a comfort zone comprising:

a temperature sensor for sensing an actual temperature associated with said zone;

a heating valve operative in a first mode for modulating the flow rate of heated air conveyed through a first supply air duct to said zone, except for possibly some hysteresis range around a set point temperature, when said actual temperature is immediately below said set point temperature and said hysteresis range if present, said heating valve is maintained at a first substantially constant intermediate open position within a dead band region and provides a variable degree of opening that varies as a function of said actual temperature beyond said dead band region, and when said actual temperature is immediately above said set point temperature and said hysteresis range if present, said heating valve is maintained at a first substantially constant predetermined minimum position that is less than said first intermediate open position; and a cooling valve operative in a first mode for modulating the flow rate of cooled air conveyed to said zone through a second supply air duct sepaarate from said first duct, except for possibly some hysteresis range around said set point temperature, when said actual temperature is immediately above said set point temperature and said hysteresis range if present, said cooling valve is maintained at a second substantially constant intermediate open position within said dead band region and provides a variable degree of opening that varies as a function of said actual temperature beyond said dead band region, and when said actual temperature is immediately below said set point temperature and said hysteresis range if present, said cooling valve is maintained at a second substantially constant predetermined minimum position that a is less than said second intermediate open position, whereby said heating and cooling valves assure a predetermined minimum airflow rate around said set point temperature.

11. The HVAC apparatus as recited in claim 10, further comprising a heater disposed upstream of said heating valve and a cooling heat exchanger disposed upstream of said cooling valve.

12. The HVAC apparatus as recited in claim 10, wherein said valves are selectively operative in said first and a second mode, with said valves moving in unison during said second mode.

13. The HVAC apparatus as recited in claim 10, further comprising at least a first potentiometer for adjusting said first and second substantially constant intermediate open positions of said heating valve and said cooling valve so that said intermediate open positions are not necessarily equal.

14. The HVAC apparatus as recited in claim 10, further comprising a second potentiometer for adjusting said dead band region.

15. The HVAC apparatus as recited in claim 10, further comprising at least a third potentiometer for adjusting said first and second predetermined minimum positions of said heating valve and said cooling valve.

16. The HVAC apparatus as recited in claim 10, wherein said valves are substantially closed when at their said minimum position to minimize any mixing of said heated air and said cooled air.

17. The HVAC apparatus as recited in claim 10, further comprising a control for sequentially switching said valves between said intermediate open position and said minimum position when said actual temperature reaches said set point temperature.

18. The HVAC apparatus as recited in claim 10, further comprising a control for simultaneously switching said valves between said intermediate open position and said minimum position when said actual temperature reaches said set point temperature.

19. An HVAC apparatus for conditioning the temperature of a comfort zone comprising:

a temperature sensor for sensing an actual temperature associated with said zone;

a heating valve operative in a first mode for modulating the flow rate of heated air conveyed through a first supply air duct to said zone, except for possibly some hysteresis range around a set point temperature, when said actual temperature is immediately below said set point temperature and said hysteresis range if present, said heating valve is maintained at a first substantially constant intermediate open position within a dead band region and provides a variable degree of opening that varies as a function of said actual temperature beyond said dead band region, and when said actual temperature is immediately above said set point temperature and said hysteresis range if present said heating valve is substantially closed;

a cooling valve operative in a first mode for modulating the flow rate of cooled air conveyed to said zone through a second supply air duct separate from said first duct, except for possibly some hysteresis range around said set point temperature, when said actual temperature is immediately above said set point temperature and said hysteresis range if presennt, said cooling valve is maintained at a second substantially constant intermediate open position within said dead band region and provides a variable degree of opening that varies as a function of said actual temperature beyond said dead band region, and when said actual temperature is immediately below said set point temperature and said hysteresis range if present, said cooling valve is substantially closed, whereby said heating and cooling valves assure a minimum airflow rate around said set point temperature while substantially preventing a stable conditioning where both valves are partially open; and at least a first potentiometer for adjusting said first and second generally constant intermediate open positions of said heating valve and said cooling valve so that said intermediate open positions are not necessarily equal.

20. The HVAC apparatus as recited in claim 19, further comprising a control for simultaneously switching said valves between substantially closed and said intermediate open when said actual temperature reaches said set point temperature.

21. The HVAC apparatus as recited in claim 19, further comprising a control for sequentially switching said valves between substantially closed and said intermediate open position when said actual temperature reaches said set point temperature.

22. The HVAC apparatus as recited in claim 10, further comprising a second potentiometer for adjusting said dead band region.

23. The HVAC apparatus as recited in claim 19, further comprising a heater disposed upstream of said heating valve and a cooling heat exchanger disposed upstream of said cooling valve.

24. The HVAC apparatus as recited in claim 19, wherein said valves are selectively operative in said first and a second mode, with said valves moving in unison during said second mode.

* * * * *

UNITED STATES PATENT AND TRADEMARK OFFICE

CERTIFICATE OF CORRECTION

PATENT NO. : 4,917,174

DATED : April 17, 1990

INVENTOR(S) : Harry K. Ring

It is certified that error appears in the above-identified patent and that said Letters Patent is hereby corrected as shown below:

Column 1, line 26, "thermostate" should be --thermostat--.

Column 3, line 10, "32" should be --30--.

Column 3, line 45, "whle" should be --while--.

Column 4, line 10, "sensors" should be --sensor--.

Column 4, line 10, delete the words "and 100".

Claim 1, Column 5, line 22, after the word "possibly" insert --some--.

Claim 10, Column 6, line 48, "sepaarate" should be --separate--.

Claim 19, Column 8, line 1, after the words "if present" insert --,--.

UNITED STATES PATENT AND TRADEMARK OFFICE

CERTIFICATE OF CORRECTION

PATENT NO. : 4,917,174

DATED : April 17, 1990

INVENTOR(S) : Harry K. Ring

It is certified that error appears in the above-identified patent and that said Letters Patent is hereby corrected as shown below:

Claim 19, Column 8, line 10, "preseent" should be --present--.

Claim 22, Column 8, line 39, "10" should be --19--.

Signed and Sealed this

Fifteenth Day of September, 1992

*Attest:*

DOUGLAS B. COMER

*Attesting Officer*

*Acting Commissioner of Patents and Trademarks*